US005115234A

United States Patent [19]

Levinski et al.

[11] Patent Number: 5,115,234

[45] Date of Patent: May 19, 1992

[54] KEYPAD CONTROLLER FOR COPIER-DUPLICATOR

[75] Inventors: Charles B. Levinski, South River; John M. Persel, Toms River; David N. Widmann, Manasquan, all of N.J.

[73] Assignee: Hecon Corporation, Eatontown, N.J.

[21] Appl. No.: 554,667

[22] Filed: Jul. 17, 1990

[51] Int. Cl.[5] ..... G03G 15/00; G07C 3/10

[52] U.S. Cl. ..... 340/825.310; 355/201; 377/15; 377/16

[58] Field of Search ..... 355/201, 133; 377/2, 377/15, 16, 26, 27; 340/825.31, 825.33

[56] References Cited

U.S. PATENT DOCUMENTS

| | | | |
|---|---|---|---|
| Re. 32,253 | 9/1986 | Bartulis et al. | 355/14 C |
| 4,475,221 | 10/1984 | Kawamura et al. | 377/2 |
| 4,501,485 | 2/1985 | Tsudaka | 355/6 |
| 4,531,826 | 7/1985 | Stoughton et al. | 355/14 CU |
| 4,588,286 | 5/1986 | Stockburger et al. | 355/133 |
| 4,615,609 | 10/1986 | Honma | 355/14 R |
| 4,727,369 | 2/1988 | Rode et al. | 340/825.31 |
| 4,812,628 | 3/1989 | Boston et al. | 340/825.33 |
| 4,833,532 | 5/1989 | Abe | 358/80 |

FOREIGN PATENT DOCUMENTS

| | | | |
|---|---|---|---|
| 5770554 | 10/1980 | Japan | 355/201 |
| 59-24858 | 2/1984 | Japan | 355/201 |
| 6191671 | 10/1984 | Japan | 355/201 |
| 1253761 | 4/1988 | Japan | 355/201 |
| 273284 | 9/1988 | Japan | 355/201 |

*Primary Examiner*—Donald J. Yusko
*Assistant Examiner*—John Giust
*Attorney, Agent, or Firm*—Louis Weinstein

[57] ABSTRACT

Method and apparatus for operating a copier-duplicator which initially produces a master and thereafter produces copies from the master. The copier-duplicator is enabled upon receipt of a valid access code to begin producing the master and copies thereof. Counts of the number of masters and copies are accumulated. The copy count is compared against a minimum amount and each time a new master is made and if the number of copies produced is less than said minimum, a violation count is stored together with its associated access code. If the copier-duplicator is in a lock-out mode, access is denied to the access code having a violation. If in a flag mode, access to the machine is permitted even if a violation code is present. However, there is a capability of displaying all of those access codes having a violation associated therewith. It is further possible to prevent access to the copier-duplicator in the event that the number of copies or masters exceeds a maximum permissible amount.

30 Claims, 3 Drawing Sheets

KEYPAD CONTROLLER FOR COPIER-DUPLICATOR

FIELD OF THE INVENTION

The present invention relates to copiers and duplicators, and more particularly, to a novel key operated controller for controlling the use of such copier-duplicators to obtain more economic operation thereof.

BACKGROUND OF THE INVENTION

Copier-duplicators, often referred to as "stencil-duplicators" are copying devices that have been recently developed for replacing the old "mimeo" type duplicators. Such mimeo machines were clumsy, had poor print quality, and employed a chemical system to generate copies which has an offensive smell. Nevertheless, the old mimeo machines were less expensive to operate as compared with xerographic type photocopy machines, which has accounted for the popularity of mimeo machines, especially in school systems.

Several years ago it was discovered that the chemical system employed in mimeo machines is hazardous to human health and the use of the conventional mimeo machine has consequently been curtailed in many locales.

The copier-duplicator has thus become the obvious and popular substitute for the conventional mimeo machine.

A copier-duplicator employs facsimile technology to simulate the functions of the old mimeo machine and also has many additional performance enhancements which include ease of operation, improved print quality, and odor-free copying. The copier-duplicator functions in much the same way as a xerographic type photocopy machine. The operation is such that an original is placed in a facsimile style feeder, where it is scanned as it is slowly drawn into the machine. A master is prepared from the scanned original by way of a printer similar to a facsimile thermal printer and simultaneously therewith the master is automatically wrapped about an ink drum. Once the master is completed, which task typically requires about thirty seconds, copies may be made in a manner similar to a printing press.

The ink from the drum carrying the master transfers through the openings in the master and on to blank paper, creating copies. Copies are produced much more rapidly than the copy production rate of photocopy machines and are produced at a greatly reduced cost. Although the cost of paper is the same, copier-duplicators require only ink whereas photocopy machines require toner, fuser oil and utilize a selenium drum which deteriorates as copies are made and has a limited useful operating life. Nevertheless, the copier-duplicator operator is not aware of any of these advantages or disadvantages. The operator need only be concerned with entering the number of copies required and thereafter pressing a "start" button.

Although the copier-duplicator has distinct advantages, one of which is economy, the copier-duplicator can be more expensive than a photocopy machine under a particular set of circumstances, most typical occurring when a master (which is comparatively expensive) is produced for the purpose of making only a small number of copies. Since the master typically costs from \$0.30 to \$0.75 to produce and cannot be reused, the total cost for a copying session can be relatively high if only a few copies are made, the price per copy being a function of the cost of a copy plus the cost of the master divided by the number of copies being produced by said master.

To illustrate this point, consider a copier with a cost of \$0.05 per copy and a copier-duplicator with a cost of \$0.50 per master and \$0.01 per copy. The cost for making five copies on the copier is \$0.25. However, the cost for making the same five copies on the copier-duplicator is \$0.55. At ten copies, the total cost of copies on the copier is \$0.50 while the cost for the same number of copies on the copier-duplicator is \$0.60. The break-even point occurs at thirteen copies in the example given, i.e. for less than thirteen copies the copier is cheaper and for thirteen or more copies the copier-duplicator is cheaper.

Since copier-duplicators are typically sold based on the fact that their cost per copy is less than that of a photocopy machine, it is important to be able to prevent abuse by lax or unconcerned users.

BRIEF DESCRIPTION OF THE INVENTION

The present invention provides a key operated controller for copier-duplicators which is characterized by comprising a control device for controlling a copier-duplicator which assures economical usage of the copier-duplicator by limiting its use to economical applications.

The controller of the present invention counts the number of masters and copies that are made for each user account number and stores this data for subsequent review. Since a duplicator becomes more cost effective as the ratio of copies to masters increases, economical use of the duplicator is insured by inserting a programmable minimum ratio into the controller memory whereby when the user makes less than the specified minimum, such user will be locked out in future attempts to make copies, which feature is an option that can be selected by the key operator or administrator. Alternatively, the lock-out feature may be substituted by providing an identification in a printed report of those users who make less copies than the selected minimum and the number of occasions upon which such uneconomical use has occurred.

The controller has a manually operable keypad for entry of an identification code, an account number to which the cost of the job being performed should be charged, and the size of the job run. If the operator's identification code is properly entered and is valid, the operator gains access to the machine.

The account number and job run data are entered and stored in the controller for future review as well as providing a means for either locking out or identifying uneconomical users of the copier-duplicator by preventing subsequent use of the copier equipment in the event that the preprogrammed copies to master ratio is not achieved or alternatively providing a print-out of this condition. The system is user friendly and provides easily understandable "menus" for guiding the user through each step in the operation of the copier.

The controller also derives all of the necessary information through only two pairs of leads from the copier-duplicator and requires only one more pair of leads to control operation of the copier-duplicator. This arrangement, coupled with the fact that the incoming master and copier pulses are multiplexed, allows the use of a simpler and less expensive microprocessor.

OBJECTS OF THE INVENTION

It is, therefore, one object of the present invention to provide a novel controller for copier-duplicators and the like which significantly reduces the uneconomical use of such equipment.

Still another object of the present invention is to provide a novel controller for copier-duplicators and the like in which data indicative of the copies to master ratio, is stored together with the identity of the operator inputting the copies to master ratio for either identifying such operators or preventing their subsequent usage of the copier-duplicator in the event that the stored ratio does not at least equal a predetermined minimum ratio which is programmed into the controller.

BRIEF DESCRIPTION OF THE FIGURES

The above, as well as other objects of the present invention will become apparent when reading the accompanying description and drawings, in which.

DETAILED DESCRIPTION OF THE INVENTION

Figure 1:
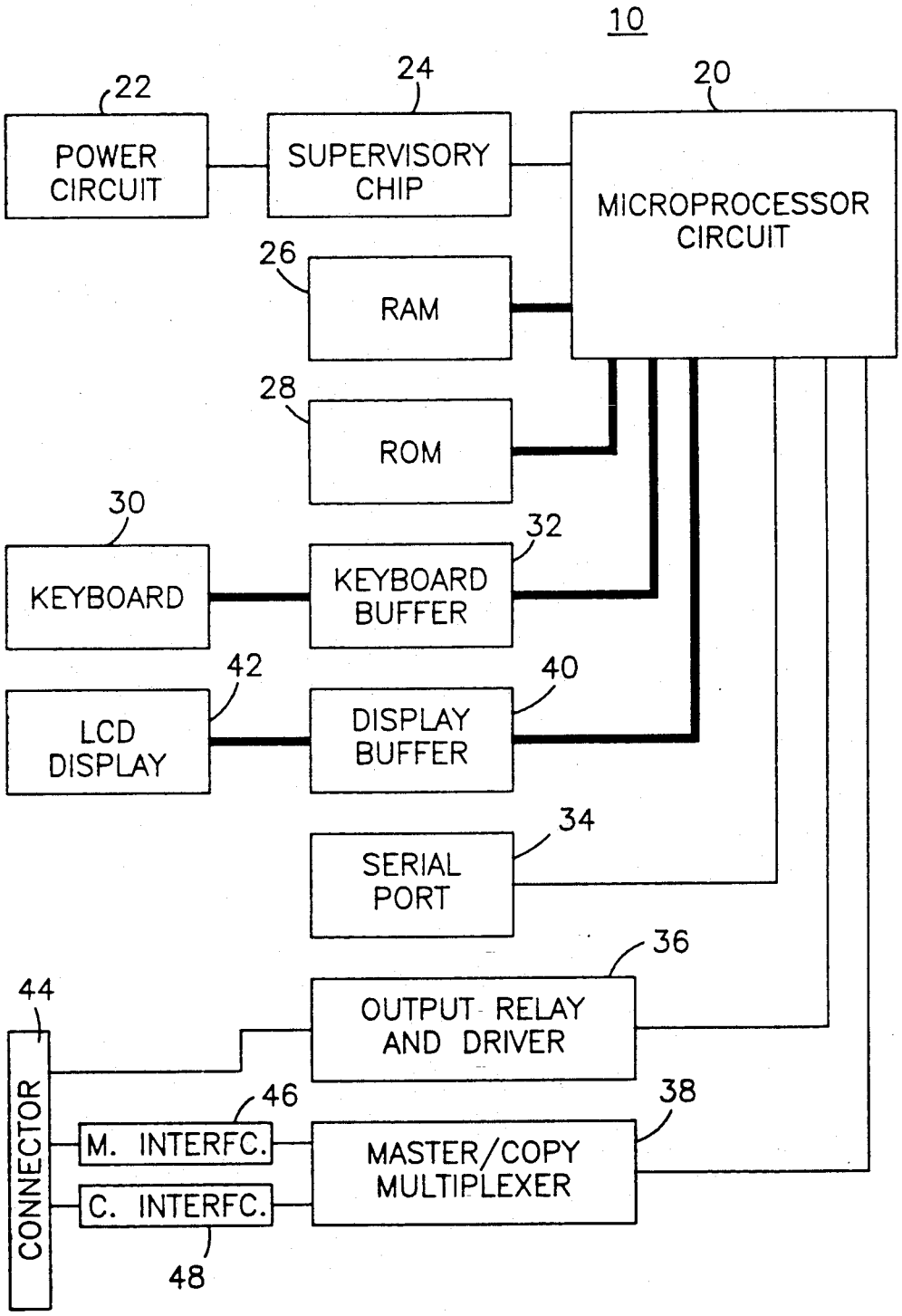
FIG. 1 is a simplified block diagram of a controller embodying the principles of the present invention.
Figures 1, 2:
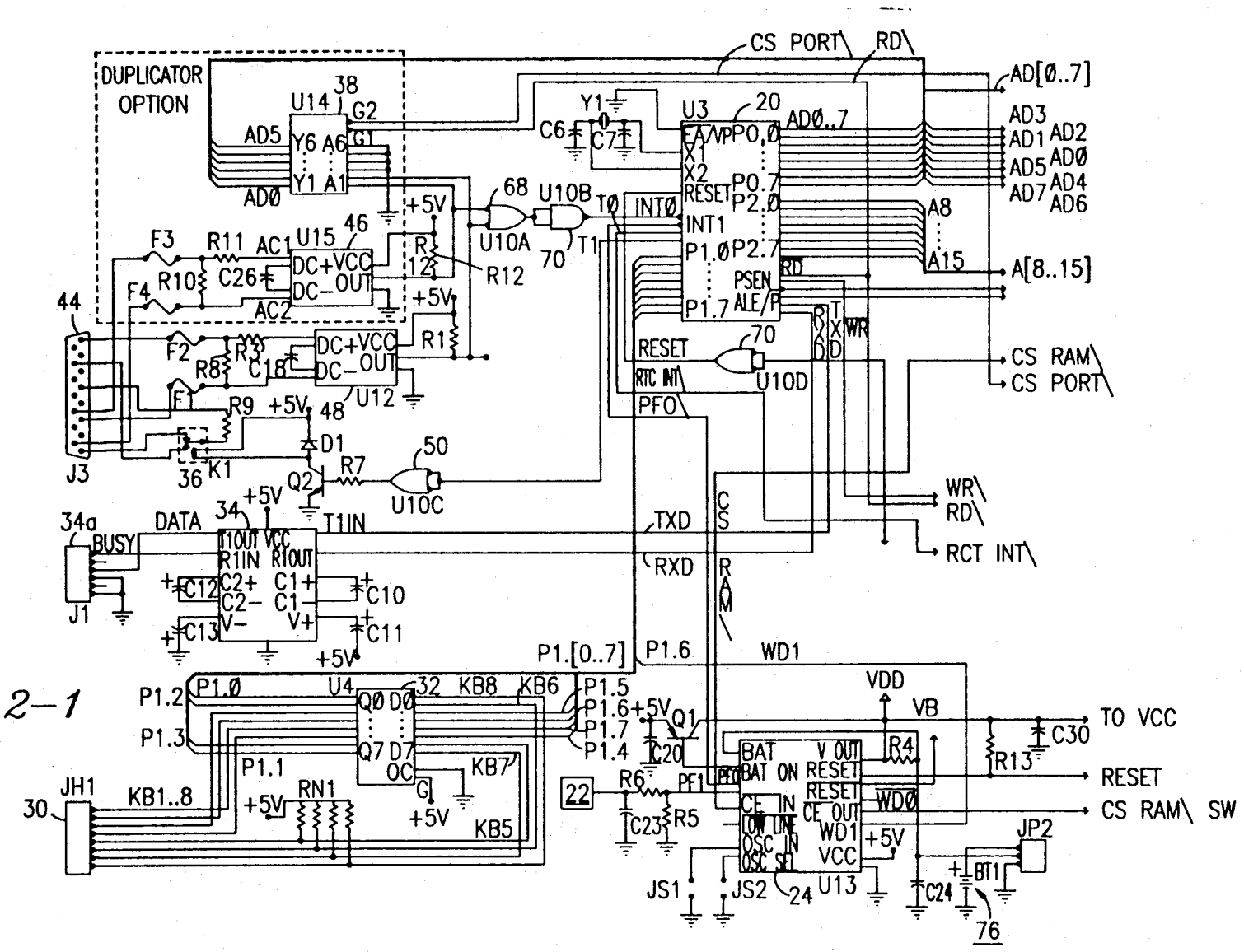
FIG. 2 shows a more detailed schematic diagram of the controller of FIG. 1.
Figure 2:
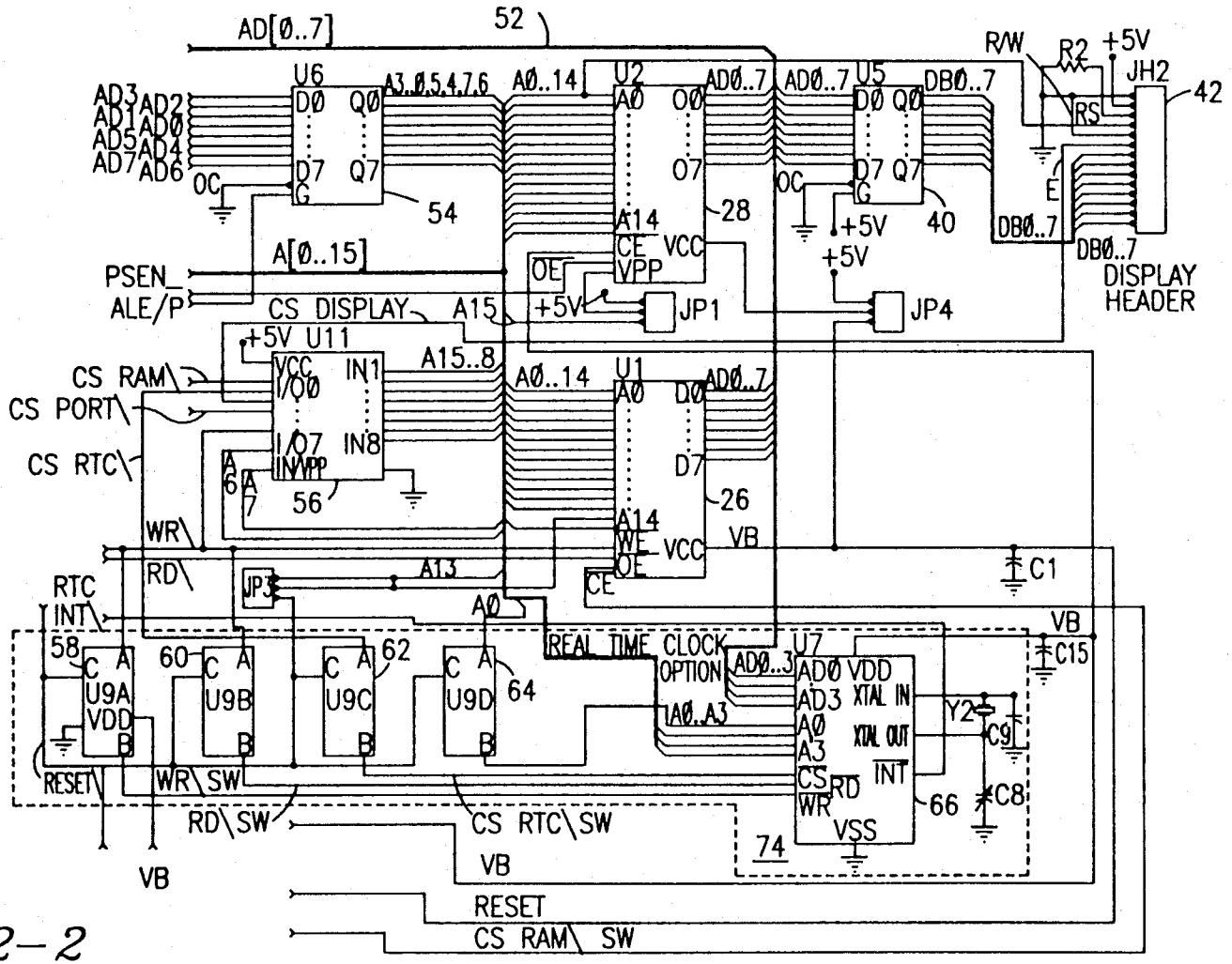

The keyboard control copier-duplicator 10 of the present invention, as shown in FIG. 1 and in greater detail in FIG. 2 allows the system administrator to require the entry of a valid account and department number in order to gain access to the machine; to set limits on the number of masters and copies that can be made against a particular account or department; to keep track of the actual usage of the copier-duplicator by account and department; and, most importantly, to set a minimum number of copies that can be made against the master, and that data indicative of an operator failing to maintain at least such minimum economic usage is stored, which features are at the heart of the unique features of the present invention.

FIGS. 1 and 2 show one representative implementation for the controller 10 of the present invention.

The controller as implemented in the present embodiment consists of a microprocessor-based controller comprising a microprocessor circuit (CPU) 20, working with a power supply 22, supervisory chip 24, random access memory (RAM) 26, read-only memory (ROM) 28 (or EPROM as shown in FIG. 2), sixteen position keyboard 30 with keyboard buffer 32, serial port 34, output relay and associated driver 36, multiplexer circuit 38, input/output (I/O) circuits 46, 48 for the two copier-duplicator inputs, as well as a liquid crystal display (LCD) 42, and a display buffer 40. FIG. 2 shows further circuits including latch or buffer 54 switches 58-64 for operating selected circuits under control of CPU 20, real-time clock 66 and gates 50, 68 and 70. The section labelled "Duplicator Option" in dotted rectangle 72 is employed in the KCCD 10. However, the section labelled "Real-Time Clock Option" in dotted rectangle 74 is normally not employed and may be omitted.

The CPU 20 is preferably an 8031 type processor which handles all data storage, I/O and copier-duplicator control.

Power supply 22 is preferably an external, wall mount DC type with an internal voltage regulator and a sense line which allows the voltage at the input to the regulator to be monitored. This level is used to provide advance warning of a power failure. The main output of power supply 22 is used to power all of the KCCD circuitry 10. The sense line, which is the only line shown on the FIG. 1 hardware block diagram, is coupled to supervisory chip 24.

Supervisory chip 24 performs three primary functions. First, chip 24 provides a sensing circuit that a detects a decrease in the voltage input to the power supply's voltage regulator. By monitoring this line, the supervisory chip detects an imminent power failure before the output voltage goes out of regulation and signals microprocessor 20 that failure is imminent. Microprocessor 20 completes any write commands that were in process (a task that takes less than the warning time) and suspends all further read-write activities) thereby assuring that "garbage" is not written to the memory. If and when the voltage drops to a low level which prevents the regulator from functioning correctly, supervisory chip 24 drives microprocessor 20 into reset through gate 70 and maintains the microprocessor in the reset condition until power is restored.

The second function of the supervisory chip 24 is to provide a smooth transition to the onboard battery 76 (FIG. 2) which protects the contents of RAM 26 when primary power is lost. The memory can be protected for at least thirty days in the KCCD under battery power.

The third function of the supervisory chip is to act as a "watchdog timer" which is a hardware device that will reset the microprocessor after a fixed time period (through the RESET line—see FIG. 2) unless it is reset prior to timing out. Thus, if microprocessor 20 is no longer able to execute its program for any reason (for example, due to getting "lost" after an electrostatic discharge) the "watchdog timer" within the supervisory chip 24 times out and resets microprocessor 20 allowing the KCCD 10 to return to its normal operating condition. In one preferred embodiment the KCCD "watchdog timer" resets microprocessor 20 after approximately 1.20 seconds unless told not to (i.e. reset) by the program, it being understood that the normal operation of the program will continually reset the "watchdog timer" allowing time-out to occur in the event of a problem developing within the microprocessor due, for example, to an electrostatic discharge.

RAM 26 and ROM (i.e. EPROM) 28 operate in the manner common to most such devices. ROM 28 stores the KCCD program while RAM 26 (which is preferably a static RAM) stores the copier-duplicator usage information, valid account and department numbers, limits, costing information and all other variable information.

Keyboard 30 accepts manual inputs from an operator. Microprocessor 20 sends a four (4) bit word to the vertical columns of keyboard 30 by buffer 32 and interrogates the horizontal rows to determine which keys are pressed, the pressed keys creating a circuit closure between predetermined horizontal and vertical lines. Buffer 32 captures the information, simplifying collection by microprocessor 20.

LCD display 42 and buffer 40 utilize and display all operator information. Microprocessor 20 sends appropriate display commands to LCD display 42 by way of buffer 40 which are read by the operator.

The serial port 34 is utilized to print the collected copier-duplicator usage data as well as to allow bidirectional communications. Serial port 34 may thus be connected to a printer or a modem, for example, through connector 34a. In this manner, personal computer-based programs may be utilized to automate the collection of usage data. Microprocessor 20 sends the character to be transmitted to the RS-232 chip which handles the voltage conversion from 5 to ± 12 volts.

Output relay 36 is used to control a copier-duplicator, coupled to system 10 by connector 44, by enabling or disabling it. For example, if the user information entered by way of the keyboard is invalid, the copier-duplicator coupled to the output relay and driver 36 by connector 44 is disabled, i.e. the relay is open. When valid data is entered by way of keyboard 30, the copier-duplicator is enabled. Other criteria to be described hereinbelow in the program section can also be utilized to disable the copier-duplicator.

The copier-duplicator provides two different pulses: one for each master produced and one for each copy produced. The master and copy interface circuits 46 and 48 are connected to the copier-duplicator through connector 44 and supply these pulses to the master/-copy multiplexer 38. Interface circuits 46 and 48 make sure the pulse polarity is correct by way of a full wave bridge rectifier, and then filter the rectified pulse to remove noise and short term transients.

The multiplexer 38 coupled to circuits 46 and 48 enables microprocessor 20 to determine if a given pulse is a copy or a master by utilizing only one processor interrupt, i.e. INTO, FIG. 2. Once it is determined that an interrupt is present, microprocessor 20 polls multiplexer circuit 38 directly to determine which pulse (master or copy) has been received.

The programs entered into ROM 28, which is preferably an EPROM include: POWER-UP, RESTART, LOOP, EXIT, DEPARTMENT, CHECK, OK, NORMAL, MAINTENANCE, PRINTMENU, ACNTMENU, DEPTMENU, DISPLAYMENU, VIOMENU, VIOMENU 1 AND CALLKEYOPERATOR, which programs are structured as follows:

The multiplexer 38 coupled to circuits 46 and 48 enables microprocessor 20 to determine if a given pulse is a copy or a master by utilizing only one processor interrupt, i.e. INTO, Fig. 2. Once it is determined that an interrupt is present, microprocessor 20 polls multiplexer circuit 38 directly to determine which pulse (master or copy) has been received.

The programs entered into ROM 28, which is preferably an EPROM include: POWER-UP, RESTART, LOOP, EXIT, DEPARTMENT, CHECK, OK, NORMAL, MAINTENANCE, PRINTMENU, ACNTMENU, DEPTMENU, DISPLAYMENU, VIOMENU, VIOMENU 1 and CALLKEYOPERATOR, which programs are structured as follows:

KCCD SOFTWARE FLOWCHART

```
POWER UP:
Reset copy control relay.
Initialize LCD display.
Go to RESTART.

RESTART:
Display "Self Test" message.
Reset copy control relay.
Initialize hardware.
Go to LOOP.

LOOP:
Reset copy control relay.
Check RAM Checksums.
```

```
     If no RAM errors, continue.
     If RAM errors, go to CALLKEYOPERATOR.
Display scrolling prompt.
Check if keys pressed.
     If none pressed, continue.
     If Password Reset combination is pressed,
         reset passwords.
     If any other key pressed, go to EXIT.
Go to LOOP.
EXIT:
Capture entered number.
     If number is maintenance password, then go
          to MAINTENANCE.
     If number is valid, go to DEPARTMENT.
Display "Invalid Account", if number is invalid.
Increment Invalid Account counter.
     If Invalid Account counter = 3, then
          disable KCCD for 1 minute; reset
          Invalid Account counter to zero.
     If Invalid Account counter <> 3, continue.
Go to RESTART.

DEPARTMENT:
Capture entered Department Number.
     If Department Number is valid, go to CHECK.
     If Department Number is invalid, display
          "Invalid Department"; continue.
Go to RESTART.

CHECK:
Compare account master total to account master
          limit.
     If total is => limit, display "Limit
          Reached"; go to RESTART.
     If total is < limit, continue.
Compare account copy total to account copy
          limit.
     If total is => limit, display "Limit
          Reached"; go to RESTART.
     If total is < limit, continue.

Compare department master total to 64,000.
     If total is => 64,000, display "Limit
          Reached"; go to RESTART.
     If total is < 64,000, continue.
Compare department copy total to 64,000.
     If total is => 64,000, display "Limit
          Reached"; go to RESTART.
     If total is < 64,000, continue.
Check KCCD configuration.
     If KCCD is configured in Lock-Out Mode,
               If violation flag <> 0, then
          display "Violation"; go to RESTART.
               If violation flag = 0, then
          go to OK.
     If KCCD is configured in Flag Mode, then
          go to OK.
```

```
OK:
Set copy control relay (enable
          copier-duplicator).
Display account number and master total.
Go to NORMAL.

NORMAL:
Await incoming pulse or keypad entry.
     If keypad entry = "*" then go to RESTART.
     If incoming pulse is not detected, go
          to NORMAL.
     If incoming pulse is detected, then
          continue.
Poll multiplexer chip.
     If incoming pulse is a master pulse, then
          increment master total; update
          display; check scratchpad copy/master.
             If scratchpad copy/master = 0,
          then check sequential master mode.
             If sequential master mode
          allowed, then continue
             If sequential master mode not
          allowed, then increment violations
          counter for the account number stored
          in scratchpad, then continue.
             If scratchpad copies per master
          is < minimum copy limit but not = 0,
          then increment violations counter for
          the account number stored in
          scratchpad, then continue.
      Compare account master total to account
          master limit.
             If total is => limit, display
          "Limit Reached"; go to RESTART.
             If total is < limit, continue.
      Compare department master total to 64,000.
             If total is => 64,000 display
          "Limit Reached"; go to RESTART.
             If total is < 64,000, continue.
      Check KCCD configuration.
             If KCCD is configured in Lock-Out
          Mode, then
                If violation flag <> 0, then
                display "Violation"; go to
                RESTART.
                If violation flag = 0, then
                continue.
             If KCCD is configured in Flag Mode,
          then continue.
     If incoming pulse is a copy pulse, then
          increment copy total; update display;
          increment scratchpad copy total;
          compare account copy total to account
          copy limit.
             If total is => limit, display
          "Limit Reached"; go to RESTART.
             If total is < limit, continue.
```

```
     Compare department copy total to 64,000.
             If total is => 64,000, display
          "Limit Reached"; go to RESTART.
             If total is < 64,000, continue.
Go to NORMAL.

MAINTENANCE:
Display "Maintenance Menu".
Wait for key input.
     If key = 0, then calculate and display
          ROM checksum.
     If key = 1, then set minimum
          copies/master.
     If key = 2, then set cost/copy and
          cost/master.
     If key = 3, then set account
          copy/master limits.
     If key = 4, then display total
          copy/total master count.
     If key = 5, then change location code.
     If key = 6, then check master password
          entered.
             If master password is correct,
          change passwords.
             If master password is not correct,
          go to RESTART.
     If key = 7, then go to PRINTMENU.
     If key = 8, then set timeout.
     If key = 9, then check master password
          entered.
             If master password is correct,
          clear all memory; allow selection of
          Lock-Out or Flag Mode; select whether
          violations counters are reset with
          function "E"; select sequential master
          to be produced with or without
          violation.
             If master password is not correct,
          go to RESTART.
     If key = A, then go to ACNTMENU.
     If key = B, then go to VIOMENU.
     If key = C, then go to DISPLAYMENU.
     If key = D, then go to DEPTMENU.
     If key = E, then check maintenance password
          entered.
             If maintenance password is correct,
          reset the copy and master totals to
          zero; reset the violations to zero if
          configured that way.
             If maintenance password is not
          correct, go to RESTART.
     If key = "*" then go to RESTART.
Go to MAINTENANCE.

PRINTMENU:
Check printer status.
```

```
     If printer off line display "Print Error";
          go to MAINTENANCE.
     If printer on line, then continue.
Wait for key input.
     If key = A, then print all reports.
     If key = B, then print copies by
          account report.
     If key = C, then print masters by
          account report.
     If key = D, then print copies by
          department report.
     If key = E, then print masters by
          department report.
     If key = "*" then go to MAINTENANCE.
Go to PRINTMENU.
ACNTMENU:
Display "ACNT MENU"
Wait for key input.
     If key = C, then enter accounts and clear
          master and copy totals until "*" key
          pressed alone.
     If key = D, then enter accounts and disable
          until "*" pressed alone.
     If key = E, then enter accounts and enable
          until "*" pressed alone.
     If key = "*", then go to MAINTENANCE.
Go to ACNTMENU.

DEPTMENU:
Display "DEPT MENU".
Wait for key input.
     If key = C, then enter departments and
          clear both master and copy totals
          until "*" key pressed alone.
     If key = D, then enter departments and
          disable until "*" pressed alone.
     If key = E, then enter departments and
          enable until "*" pressed alone.
     If key = "*", then go to MAINTENANCE.
Go to DEPTMENU.

DISPLAYMENU:
Display "Display Menu AD".
Wait for key input.
     If key = A, then display "Account Menu";
          wait for key.
             If key = A, then display "Master
          Menu"; wait for key.
                  If key = A, then display
             account masters.
                  Scroll with D and E keys,
             exit with "*" key.
                  If key = B, then display
             account master limits.
                  Scroll with D and E keys,
             exit with "*" key.
```

```
        If key = D, then display "Copy Menu";
            wait for key.
                If key = A, then display
            account copies.
                Scroll with D and E keys,
            exit with "*" key.
                If key = B, then display
            account copy limits.
                Scroll with D and E keys,
            exit with "*" key.
    If key = D, then display "Department Menu";
        wait for key.
            If key = A, then display department
        masters.
            Scroll with D and E keys, exit
        with "*" key.
            If key = D, then display department
        copies.
            Scroll with D and E keys, exit
        with "*" key.
    If key = "*", then go to MAINTENANCE.
Go to DISPLAYMENU.

VIOMENU:
Flash display "Violations Menu".
Go to VIOMENU1.

VIOMENU1:
Display "All/Acnt/Dis ABC".
Wait for key input.
    If key = A, then wait for input.
            If input = maintenance password,
        then reset all violations counters
        to zero.
            If input    maintenance password,
        then go to VIOMENU1.
        Go to VIOMENU1.
    If key = B, then wait for input.
            If input = "*", then go to
        VIOMENU1.
            If input    valid account
        number, then flash "Invalid
        Account"; go to VIOMENU1.
            If input = valid account number,
        then continue.
                If violation counter = 0,
          then flash "No Violations";
          go to VIOMENU1.
                If violation counter < > 0,
          then reset violation counter to
          0; go to VIOMENU1.
   If key = C, then display "Display
        Violators"; display violators in
        response to "*" key; use D and E
        keys to scroll; use 0-9 keys to
        display specific violator.
```

```
     If key = "*", then go to MAINTENANCE.
Go to VIOMENU.

CALLKEYOPERATOR:
Display "Call Key Operator".
Wait for key input.
     If key = "*", then print checksum listing;
          print all reports; go to
          CALLKEYOPERATOR.
     If key = C92 simultaneously, then continue.
Reset timeout, passwords, minimum copies per
          master, cost per copy, cost per master
          and location code to default values.
Check RAM data, searching for obvious data
          errors.
             If none, continue.
             If found, delete; continue.
Replace stored checksum with new calculated
          checksum.
Go to RESTART.
```

In the POWER-UP mode, when power is turned on, the microprocessor 20 resets relay 36 through gate 50, transistor T1 and diode D1. The LCD display 42, coupled to microprocessor 20 by bus 52 and buffer 40, is initialized, whereupon the program jumps to the RESTART subroutine.

In the POWER-UP mode, when power is turned on, the microprocessor 20 resets relay 36 through gate 50, transistor T1 and diode D1. The LCD display 42, coupled to microprocessor 20 by bus 52 and buffer 40, is intialized, whereupon the program jumps to the RESTART subroutine.

During the RESTART subroutine, display 42 is caused to generate a "Self Test" display, copy control relay 36 is reset and the system hardware is initialized, whereupon the program jumps to the LOOP subroutine.

During the LOOP subroutine, copy control relay 36 is reset and the RAM checksums are checked by CPU 20 which determines the checksums of various sections of RAM 26 and checks these sums against the previously stored checksums of each such section of RAM. If there are no errors, the LOOP subroutine continues whereupon the scrolling prompt is displayed. Thereupon, the microprocessor checks to determine if any keys from the keypad 30 have been pressed. If no keys have been pressed, the LOOP routine continues. If the Password Reset combination is pressed, the passwords are reset upon entry of a special code. If any other key is pressed, the program jumps to the EXIT subroutine. If no key is pressed, the program continues to loop through the LOOP subroutine.

When any key is pressed in the LOOP subroutine, the EXIT subroutine is entered and the entered number is captured by buffer 32 and then transferred to the CPU 20. If the number is a Maintenance Password the program jumps to the MAINTENANCE subroutine. If the number entered is valid, the program jumps to the DEPARTMENT subroutine. If the number is invalid, "INVALID ACCOUNT" is displayed by LCD display 42. The Invalid Account counter is incremented by one. If three invalid account numbers are entered, Invalid Account counter accumulates a count of three which disables the KCCD for one minute and thereafter resets the Invalid Account counter to zero. If the Invalid Account counter is either less than or greater than three, the program jumps to the subroutine.

The DEPARTMENT subroutine, which is entered when a valid account number is detected in the EXIT subroutine, captures a Department Number entered by keyboard record 30 and latched in buffer 32. If the Department Number is valid, the program jumps to the CHECK subroutine. If the Department Number is invalid, CPU 20 causes LCD display 42 to display the legend "INVALID DEPARTMENT" and continues whereupon the program returns to the RESTART subroutine.

The CHECK subroutine is entered when a valid Department Number is detected during the DEPARTMENT subroutine whereupon the count master total is compared against the account master limit (which value may be adjusted, if desired). If the total is equal to or greater than the account master limit, CPU 20 causes display 42 to display the legend "LIMIT REACHED" and causes the program to return to the RESTART subroutine. If the total of the master count is less than the limit, the CHECK subroutine continues whereupon the account copy total is compared with the account copy limit. If the total is equal to or greater than the preset limit, CPU 20 causes the legend "LIMIT REACHED" to be displayed and the program returns to the RESTART subroutine. If the total of the account copies is less than the account copy limit, the program continues.

The department master total is compared against the quantity 64,000. If the department master total is equal to or greater than 64,000, CPU 20 causes the display legend "LIMIT REACHED" to be displayed and the program returns to the RESTART subroutine. If the department master total is less than 64,000, this subroutine continues whereupon the department copy total is compared with the value of 64,000. If the department copy total is equal to or reached than 64,000, the display "LIMIT REACHED" is presented by LCD display 42 and the program returns to the RESTART subroutine. If the department copy total is less than 64,000, the CHECK subroutine is continued whereupon the KCCD configuration is checked. If the KCCD count is configured in the LOCK-OUT mode, and if the violation flag is either greater than or less than zero, the legend "VIOLATION"0 is displayed by LCD display 42 and the program returns to the RESTART subroutine. The manner in which the KCCD 10 reacts to the violations counter depends upon its present mode. The modes are configured by way of the "Clear All Memory" function when the KCCD 10 is being set up.

In the LOCK-OUT mode, KCCD 10 waits for the user to enter an account number and verifies that the account number is valid. The copy and master totals for both accounts and departments are checked against their limits to assure that they have not been exceeded. The violations counter for that account number is then checked. If the counter does to equal zero, the KCCD 10 flashes the message "VIOLATION LOCK-OUT" returning the program to the RESTART subroutine.

In the FLAG mode, KCCD 10 waits for the user to enter an account number and verifies that the account number is valid. The copy and master totals for both accounts and departments are checked against their limits to assure that they have not been exceeded, as was described hereinabove. The Violations counter for the account number entered is then checked. If the count does not equal zero, the user is still permitted to make copies. However, if another violation occurs, the violation counter is again incremented until it reaches its maximum value. The number if violations that have occurred for that account number will be printed on the reports generated by an optional printer coupled to connector 34*a* through serial port 34.

Entering the OK subroutine from the CHECK subroutine, the program sets the copy control relay 36 enabling the copier-duplicator (not shown) coupled to and operated by KCCD 10 by connector 44. The account number and master total are then displayed by KCCD display 42 and the program then advances to the NORMAL subroutine which awaits either an incoming pulse or a keypad entry. If a keypad entry is a "*" symbol, the program returns to the RESTART subroutine. If an incoming pulse from the copier-duplicator is not detected, the program loops back to the start of the NORMAL subroutine. If an incoming pulse from the copier-duplicator is detected, the NORMAL subroutine continues whereupon the multiplexer chip 38 is polled to determine which pulse (master or copy) has been received. If the incoming pulse is a master pulse, the master total is incremented, the display is updated and a check is made to determine if the sequential master mode has been selected. If in the sequential master mode, the NORMAL subroutine continues. If the sequential master mode has not been selected and if the present account/copy master equals zero, the subroutine continues. If the present account/copy master is greater than zero, the violations counter for the account number presently selected is incremented and the program continues. The account master total is compared wit the account master limit. If the account master total is equal to or greater than the account master limit, the display legend "LIMIT REACHED" is generated by LCD display 42 and the program returns to the RESTART subroutine. If the aforementioned total is less than the limit, the NORMAL subroutine continues whereupon the department master total is compared with the limit value of 64,000. If the total is equal to or greater than 64,000, the "LIMIT REACHED" legend is displayed and the program returns to the RESTART subroutine. In the event that the total is less than the value of 64,000, the NORMAL subroutine continues whereupon the KCCD configuration is checked. If the KCCD is configured in the LOCK-OUT mode, and if the violation flag is either less than or greater than zero, the legend "VIOLATION" is displayed and the program returns to the RESTART subroutine. Thus, the KCCD, when in the LOCK-OUT mode, can lock out either due to a previous violation (stored in the violations counter) or due to detection of sequentially occurring master pulses with no intervening copy pulse when in the present job run. If the violation flag is equal to zero, the NORMAL subroutine continues whereupon if the KCCD is configured in the FLAG mode, the NORMAL subroutine is continued with the KCCD looking for incoming pulses from the copier-duplicator. If the incoming pulse is a copy pulse, the copy total is incremented, the LCD display 42 is updated and the scratch-pad copy total is incremented whereupon the account copy total is again compared with the account copy limit. If the total is equal to or greater than the limit, the legend "LIMIT REACHED" is generated and the program returns to the RESTART subroutine. If the total is less than the limit, the NORMAL subroutine continues whereupon the department copy total is compared to the value 64,000. If the total is equal to or greater than 64,000, the legend "LIMIT REACHED" is displayed and the program returns to the RESTART subroutine. If the department copy total is less than 64,000, the program loops back to the beginning of the NORMAL subroutine.

The MAINTENANCE subroutine is entered by way of the EXIT subroutine as was described hereinabove. Once the MAINTENANCE subroutine is entered, the legend "MAINTENANCE MENU" is displayed and the CPU waits for a key input. The key inputs zero through nine (0-9) and A through E plus "I" provide for various functions set forth in each of the respective keys. The program continues to loop through the MAINTENANCE subroutine until the "*" key is pressed whereupon the program returns to the RESTART subroutine. All or selected ones of the values shown in the subroutine are set during this routine.

The PRINTMENU is entered by pressing key 7 during the MAINTENANCE subroutine whereupon the printer status i checked and if the printer is off-line, the legend "PRINT ERROR" is displayed and the program returns to the MAINTENANCE subroutine. If the printer is on line, the PRINTMENU subroutine continues whereupon the system waits for a key input. The keys A through E provide for print out of various reports (or all reports) as shown in the PRINTMENU subroutine set forth hereinabove. The data called for is printed out and the program loops back to the beginning of the PRINTMENU subroutine until the key "*" is pressed, whereupon the program is returned to the MAINTENANCE subroutine.

The ACNTMENU is entered by pressing key A during the MAINTENANCE subroutine whereupon the legend "ACNT MENU" is displayed and the program waits for a key input. When key C is pressed each account is entered and the master and copy totals are cleared one at a time until the "*" key is pressed alone. If the D key is pressed, each of the accounts is entered and disabled in sequential fashion until the "*" key is pressed alone. When the E key is pressed, each account is entered and enabled until the "*" key is pressed alone. The pressing of the "*" key causes the program to return to the MAINTENANCE subroutine. Alternatively, in the absence of the pressing of the "*" key the program loops through the ACNTMENU subroutine.

The DEPTMENU subroutine is entered by pressing the D key during the MAINTENANCE subroutine whereupon the legend "DEPT MENU" is displayed. The program then waits for a key input whereupon the operations for the departments is performed in a manner similar to the operations for the accounts as was described hereinabove for the ACNTMENU routine with the specific operations performed being set forth as shown in the DEPTMENU subroutine hereinabove. The program continues to loop through the DEPTMENU subroutine until the "*" key is pressed whereupon the program jumps to the MAINTENANCE subroutine.

The DISPLAYMENU subroutine is entered by pressing the C key during the MAINTENANCE subroutine whereupon the legend "DISPLAY MENU AD" is presented in LCD display 42. The programs then waits for a key input. I the A key is pressed, the legend ACNT MENU" is displayed and the program looks for another key input. If the A key is pressed again, then the "MASTER MENU" legend is displayed and the program waits for another key input. If the A key is pressed again, then the account masters is displayed. The operator may scroll through the account masters selectively using the E and D keys for moving through the account masters respectively either forward or backward. The operator may exit by pressing the "*" key. The account master limits, account copies, account copy limits, department masters and department copies accounts may likewise be displayed and examined in a similar fashion through use of the key combinations set forth hereinabove in the DISPLAYMENU subroutine. Once the DISPLAYMENU subroutine has been entered, the program continues to loop through the DISPLAYMENU subroutine until the "*" key is pressed (after exiting from a particular display), causing the program to jump to the MAINTENANCE subroutine.

The VIOMENU subroutine is entered by pressing the B key during the MAINTENANCE subroutine whereupon the legend "VIOLATIONS MENU" is displayed and flashed whereupon the program advances to the VIOMENU1 subroutine which thereafter to displays the legend "ALL/ACNT/DIS ABC". The program then waits for a key input. If the A key is pressed, the program waits for a subsequent input. If the input equals the Maintenance Password, then all of the violations counters are reset to zero. If the input is greater than or less than the Maintenance Password, then the program continues to loop about the VIOMENU1 subroutine.

When the B key is pressed, the program waits for a subsequent key input. If the "*" key is pressed, the program returns to the start of VIOMENU1. If the input value is not equal to a valid account number, CPU 20 causes a "INVALID ACCOUNT" legend to be displayed and flashed and the program returns to the beginning of the VIOMENU1 subroutine. If the input received is a valid account number, the VIOMENU1 subroutine continues whereupon if the violation counter is equal to zero, the flashing legend "NO VIOLATIONS" is presented by the LCD display 42 and the program returns to the beginning of the VIOMENU1 subroutine. If the violations counter is greater than or less than zero, the violations counter is reset to zero and the program returns to the beginning of the VIOMENU1 subroutine.

If the C key is pressed, then the legend "DISPLAY VIOLATORS" is presented and the identifying numbers of each of the violators is displayed by pressing the "*" key. The D and E keys are utilized to scroll through the stored data. The program returns to the VIOMENU1 routine. However, if the "*" key is pressed, the program jumps to the MAINTENANCE subroutine.

The CALLKEYOPERATOR subroutine is entered when a RAM error is encountered during the LOOP subroutine whereupon the legend "CALL KEY OP- ERATOR" is displayed. The program then waits for a key input. I the "*" key is pressed, the checksum listing is printed an all reports are printed whereupon the program loops back to the beginning of the CALLKEYOPERATOR subroutine. If the keys C92 are simultaneously pressed, the CALLKEYOPERATOR subroutine continues whereupon the CPU resets time out, passwords, minimum copies per master, cost per copy, cost per master, and location code to default values. Thereafter, the RAM data is checked to search for obvious data errors. If no errors are found, the subroutine continues; if an error is found, it is deleted, and the subroutine continues whereupon the stored checksum is replaced with the new calculated checksum and the program jumps to the RESTART subroutine.

When configured the KCCD 10, there are a few additional choices that may be made. The Function E key is employed to reset the copy and masters total to zero, which function is performed during the MAINTENANCE subroutine. The system has programmed in the flexibility of determining whether or not the violations counters should also be reset at the same time. For example, the key operator may not wish the violations counters to be reset until the key operator has had an opportunity to discuss the violations with the violator. On the other hand, some key operators may feel that, since the copy totals have been reset to zero, and since violations are recorded on the print-out, the violation counter should be reset as well so that all violations if they are recorded will be for current copy information. To accommodate either of these two options, the KCCD allows the person setting up the unit to decide which of these two approaches may be selected by making the desired selection during the MAINTENANCE subroutine when pressing the 9 key.

Certain types of copier-duplicators automatically produce a "free" copy after each master in order to allow the operator to view the printed copy to determine if its appearance is satisfactory. Such copier-duplicators do not produce a copy pulse when the free copy is generated. The object of such a design is to enable a user to see what his copies will look like before making any thereby enabling the operator to make a second subsequent master. One school of thought considers this repeated making of masters a violation since the masters are made and not used; however, another school of thought would consider this function to be an intended use of the machine. To accommodate both of these schools of thought, the KCCD 10 allows the user to decide whether or not two master pulses are received one after the other, with no copy pulses received inbetween, should be treated as a violation. This is accomplished during the NORMAL subroutine as was described in detail hereinabove.

The VIOLATION subroutine is provided to enable key operators to clear violations for all accounts, individual accounts, or to review all accounts with violations by way of the display, as was set forth hereinabove.

Special assumptions which have been made in designing the system of the present invention are as follows:

The account number used to make a master "owns" that maser and is responsible to make sure that an adequate number of copies are made against it.

Other account numbers may be used to make copies against the master but the responsibility still rests with the "owner".

Since it is not known in advance how many copies will be made against the master, the system cannot prevent a violation before it occurs. However, the system utilizes the fact that a previous violation has occurred to prevent further violations. Alternatively, LOCK-OUT may be obtained if two or three violations have occurred, the KCCD having the capability of programming such a violation change or limit.

The CPU 20 automatically shifts the LCD display 42 from "Masters" to "Copies" and vice versa, whenever that type of pulse is received from the copier-duplicator coupled with the KCCD being operated thereby.

Violations can be viewed from the LCD display 42 as well as by way of the printer to accommodate users who do not purchase or own an optional printer.

The multiplexer of the incoming master and copy pulses from the copier-duplicator is important since it allows the use of a low cost microprocessor. Without the multiplexing capability, additional interrupt inputs would be required, necessitating a more expensive microprocessor.

Separate costs per copy and limits are provided for masters and copies to provide complete cost control.

In addition to controlling a copier-duplicator, it should be understood that control unit 10 may also be used with any products that generate two different pulses to represent events of different costs or limits.

The violation concept has wide ranging effects and may be applied in one form or another to any situation where it is desirable to lock-out a user who has violated some machine specific policy or alternatively to record their violations for future review and analysis.

The system of the present invention may employ a variety of state of the art solid-state chips presently available in the marketplace. For example, the circuits of FIGS. 1 and 2 may employ solid-state chips whose model numbers and manufacturing sources are set forth hereinbelow, it being understood that a number of these model numbers are available from a variety of different manufacturing sources and that chips having the capability of functioning equivalent to those set forth below may also be employed:

| Circuit Number | Chip/Part Number | Manufacturer |
|---|---|---|
| 20 | 8031 | Intel |
| 32, 54 | 74LS373 | Signetics |
| 28 | 27256 | Intel |
| Optional Printer (not shown) | P-40S | Epson |
| 34 | MAX232 | Maxim |
| 24 | MAX691 | Maxim |
| 26 | MCM60L256 | Motorola |
| 56 | 5CO32 | Intel |
| 66 | MM58274 | National Semiconductor |
| 58-64 | CD4066 | Motorola |
| 50, 68, 70 | 74LS00 | Signetics |
| 46, 48 | HCPL3700 | Hewlett-Packard |

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Control means for controlling a machine capable of performing first and second different operations and generating a first or a second pulse indicative of the performance of the respective first and second operations, said control means comprising:

means for enabling said machine responsive to receipt of a valid access code;

means for accumulating at least one of said first and second pulses;

means for storing a quantity representing a usage criteria for the machine which criteria includes a value representing a predetermined minimum number of one of said first and second different operations to provide advantageous economic use of the machine;

means responsive to determination of the present machine usage for storing a violation condition when the accumulated number of machine operations just completed is less than a stored minimum number of machine operations, said violation count being associated with a valid access code permitting the last machine usage;

means responsive to the subsequent entry of a valid access code for determining if the same access code previously entered has a violation condition associated therewith; and means for preventing access to said machine if a violation condition is present.

2. The controller of claim 1 further comprising means for displaying stored access codes and the status of their violation condition.

3. The controller of claim 1 further comprising means for printing word access codes and the statues of their violation condition.

4. The controller of claim 1 wherein said machine is a copier-duplicator.

5. The controller of claim 4 wherein said copier-duplicator generates a first type of pulse representative of production of a master and a second type of pulse representative of generating a copy from said master.

6. The controller of claim 5 wherein the pulses accumulated are copy pulses.

7. The controller of claim 6 wherein the criteria stored is the minimum number of copier pulses per master.

8. The controller of claim 1 further comprising means for presenting a human observable display of access codes and the status of their violation condition.

9. The controller of claim 8 further comprising:

means for placing said controller in a lock-out mode when in a first state and for operating the controller in a flag mode when in a second state;

means for preventing usage of the machine being controlled responsive to said first stage and the presence of a violation condition associated with the access code presently being entered.

10. The controller of claim 9 further comprising:

means for permitting operation of said machine responsive to a valid access code last entered, including means for accumulating violation conditions and associating said accumulated violation conditions with the last entered access code.

11. The controller of claim 10 further comprising:

means for providing a human observable display of stored access codes and the violation conditions associated therewith.

12. The controller of claim 1 further comprising:

means for storing a value of the maximum permissible number of machine operations for each access code;

means for accumulating pulses generated by the machine for each operation;

means for disabling machine operation when the number of pulses accumulated reaches said maximum permissible number.

13. The controller of claim 12 further comprising means responsive to entry of the next access code to maintain the machine in a disabled state hen the quantity of accumulated pulses representing machine operations associated with the entered access code is equal to said maximum permissible number.

14. The controller of claim 1 further comprising:

means for storing respective maximum permissible values for said first and second machine operations;

means for respectively comparing the accumulated pulses representing the first and second machine operations with the respective maximum permissible values for sad first and second machine operations; and means for disabling the machine when the number of at least one of the accumulated pulses reach the maximum permissible value of the associated machine operation.

15. The controller of claim 14 further comprising:

means for halting the machine operation when the number of accumulated pulses of at least one of the first and second machine operations associated with the access code just entered are above a maximum permissive limit; and means for preventing access to the machine when the number of accumulated pulses of either one of said first and second machine operations has reached the maximum permissible number.

16. The controller of claim 14 wherein said machine is a copier-duplicator machine capable of respectively producing masters and copies in which said maximum permissible values respectively represent the maximum number of masters and the maximum number of copies permitted for the associated access code.

17. The controller of claim 1 wherein the machine comprises a copier-duplicator capable of producing masters and copies wherein a first pulse is generated for the production of each master and wherein a second pulse is generated for each copy except for the first copy;

means for selectively operating said controller in a first or a second state, wherein said first state holds sequential masters to be a violation condition and said second state permits the occurrence of sequential masters without violation;

means responsive to the generation of first pulses representing the occurrence of sequential master operations and the presence of said first state for generating a violation condition associated with the present access code; and means for disabling machine operation upon the occurrence of said violation condition.

18. The controller of claim 17 further comprising:

means for storing said violation condition; and means for preventing subsequent disabling of said machine responsive to subsequent entry of the access code associated with said violation condition.

19. The controller of claim 1 further comprising:

means for storing a department code entered by an operator. each access code representing an account number associated with a particular department;

means for storing a value representing the maximum number of copies permitted for each account and for each department;

means for accumulating a count of the number of copies made for each account and for each department;

means for comparing the count accumulated for each account and its associated department with the maximum number of copies permitted; and means for disabling said machine when the accumulated pulses for either the account number or department number reaches the maximum permissible count associated therewith.

20. A controller for controlling the operation of a copier-duplicator for producing a master and a number of copies of the master for generating a first type of pulse representing the production of a master and a second type of pulse representing the generation of a copy;

first and second means for respectively accumulating said first and second pulses;

means for storing an economic usage value representing the permissible minimum number of copies reproduced from a predetermined master to assure advantageous economic use of the copier-duplicator;

first memory means for temporarily storing access codes entered by an operator for obtaining access to the copier-duplicator;

means responsive to the entry of a valid access code for enabling the copier-duplicator whereby upon operation of the copier-duplicator, said first and second pulses are accumulated;

means responsive to subsequent entry of a valid access code for comparing the subsequently entered access code with any previously entered access codes stored in said first memory means;

means for storing the number o copies produced by the machine responsive to entry of the previously entered access code stored in said first memory means when these access codes are different;

means for comparing the stored count representing the number of copies produced with the stored economic usage value representing the minimum number of copies permissible; and means for storing a violation condition for the access code associated with the violation condition when the number of copies produced from the same master is less than the permissible minimum number of copies.

21. The controller of claim 20 further comprising:

means for selectively operating the controller in either a first or a second state, said first state being a lock-out state and said second state being a flag state; and means responsive to entry of a valid access code for preventing access to the machine when the controller is in said lock-out state and a violation condition associated with said access code has previously been stored for preventing access to said machine.

22. The controller of claim 21 further comprising:

means for accumulating violation conditions and permitting operation of the machine even in the presence of a violation condition; and means for generating a human observable display of the violation condition for each valid access code.

23. A method for controlling the operation of a copier-duplicator machine capable of generating masters and copies of each master, the number of copies being selectable by an operator and being further capable of generating a first signal representing the production of a master and a second signal representing the production of a copy from said master, said method comprising the steps of:

(a) enabling the machine when a valid access code is presented to request machine operation;

(b) separately counting the number of copy and/or master pulses as they are generated;

(c) storing the access code presented in a memory;

(d) comparing the number of copies produced against a minimum permissible threshold value;

(e) storing a violation condition in said memory associated with the access code stored in memory at step (c) when the number of copies produced is less than said minimum threshold value;

(f) comparing the access codes entered in memory and having an associated violation condition against a subsequently entered access code;

(g) enabling the machine to generate copies and comparing the number of copy pulses accumulated against a minimum permissible threshold value when the subsequently entered access code does not compare with any access code in memory having a violation condition associated therewith;

(h) storing a violation condition associated with the subsequently entered access code when the copy count is less than minimum permissible threshold value.

24. The method of claim 23 wherein, the machine is maintained disabled when in a lock-out mode and a violation condition associated with the access code just entered has been previously stored in the memory.

25. The method of claim 23 wherein the machine is enabled responsive to entry of a new access code when the machine is operating in a flag mode even though a violation condition associated with the access code last entered was previously stored.

26. The method of claim 25 further comprising the step of:

producing a human observable display of the violation conditions for each access code.

27. The method of claim 23 further comprising the steps of:

comparing the number of copies produced for each access code with a maximum permissible number; and disabling the machine when the number of copies produced for an associated access code reaches the maximum permissible number.

28. The method of claim 23 further comprising the steps of:

comparing the number of masters produced for each access code with a maximum permissible number; and disabling the machine when the number of masters produced for an associated access code reaches the maximum permissible number.

29. The method of claim 23 wherein the copier-duplicator has the capability of generating a copy pulse for each copy except for the first copy made after production of the master further including the step of:

disabling the machine when the generation of sequential master pulses has been detected and the machine is in a sequential master lock-out state.

30. The method of claim 24 further comprising the step of selecting or deselecting the lock-out mode.

* * * * *

UNITED STATES PATENT AND TRADEMARK OFFICE

CERTIFICATE OF CORRECTION

PATENT NO. : 5,115,234

DATED : May 19, 1992

INVENTOR(S) : Charles B. Levinski et al.

It is certified that error appears in the above-identified patent and that said Letters Patent is hereby corrected as shown below:

Column 3

Line 20, after "which" insert -- : --

Line 23, change "Fig. 2 shows" to --Figs. 2-1 and 2-2, taken together, show--

Line 24, after "Fig. 1" insert --Figs. 2-1 and 2-2 will be referred to hereinbelow as Fig. 2, for purposes of simplicity.--

Column 4

Line 8, after "that" delete --a--

Column 6

Delete Lines 21 to 35

Columns 15 - 16

Line 33, after "input" insert --< >--

Line 39, after "input" insert --< >--

Columns 17 - 18

Delete "In the POWER-UP mode,.....RESTART subroutine."

UNITED STATES PATENT AND TRADEMARK OFFICE

CERTIFICATE OF CORRECTION

PATENT NO. : 5,115,234

DATED : May 19, 1992

INVENTOR(S) : Charles B. Levinski et al.

It is certified that error appears in the above-identified patent and that said Letters Patent is hereby corrected as shown below:

Column 19

Line 59, after "VIOLATION" delete --0--

Column 20

Line 46, change "wit" to --with--

Column 21

Line 24, change "I" to --"*"--

Line 33, change "i" to --is--

Column 22

Line 7, change "programs" to --program--

Line 8, change "I" to --If--

Line 9, insert --"-- before ACNT MENU"

Line 34, delete --to--

Column 23

Line 2, change "I" to --If--

Line 3, change "an" to --and--

UNITED STATES PATENT AND TRADEMARK OFFICE

CERTIFICATE OF CORRECTION

PATENT NO. : 5,115,234

DATED : May 19, 1992

INVENTOR(S) : Charles B. Levinski et al.

It is certified that error appears in the above-identified patent and that said Letters Patent is hereby corrected as shown below:

Line 16, change "configured" to --configuring--

Column 24

Line 16, change "multiplexer" to --multiplexing--

Column 25

Line 34, change "statues" to --status--

Line 55, change "stage" to --state--

Column 26

Line 11, change "hen" to --when--

Line 21, change "sad" to --said--

UNITED STATES PATENT AND TRADEMARK OFFICE

CERTIFICATE OF CORRECTION

PATENT NO. : 5,115,234

DATED : May 19, 1992

INVENTOR(S) : Charles B. Levinski et al

It is certified that error appears in the above-identified patent and that said Letters Patent is hereby corrected as shown below:

Column 27, line 40, change "o" to --of--.

Signed and Sealed this

Seventh Day of December, 1993

*Attest:*

*Attesting Officer*

Bruce Lehman

BRUCE LEHMAN

*Commissioner of Patents and Trademarks*